US009394664B2

(12) United States Patent
Desmeules

(10) Patent No.: US 9,394,664 B2
(45) Date of Patent: Jul. 19, 2016

(54) HYDRAULIC BREAKER HAMMER CASING ASSEMBLY FOR PILE DRIVING

(71) Applicant: Alain Desmeules, Montreal (CA)

(72) Inventor: Alain Desmeules, Montreal (CA)

(73) Assignee: Brooke Erin Desantis, Montreal, Quebec ( * ) Notice: Subject to any disclaimer, the term of this patent is extended or adjusted under 35 U.S.C. 154(b) by 684 days.

(21) Appl. No.: 13/795,709

(22) Filed: Mar. 12, 2013

(65) Prior Publication Data

US 2014/0262393 A1 Sep. 18, 2014

(51) Int. Cl.
*E02D 7/10* (2006.01)
*E02D 7/06* (2006.01)

(52) U.S. Cl.
CPC ..... *E02D 7/06* (2013.01)

(58) Field of Classification Search
CPC ..... E02D 7/06; E02D 7/10; E21B 19/086; E21B 19/24; E21B 7/022
USPC ..... 173/29
See application file for complete search history.

(56) References Cited

U.S. PATENT DOCUMENTS 3,939,922 A * 2/1976 Swenson ..... E02D 7/10 173/125
4,036,310 A * 7/1977 Schnell ..... E02D 13/10 173/131
4,075,858 A * 2/1978 Frederick ..... E02D 7/10 173/125
4,102,094 A * 7/1978 MacKinnon ..... E02D 13/04 173/195
4,102,147 A 7/1978 Jansz
4,131,166 A * 12/1978 Schnell ..... E02D 7/02 173/193
4,172,681 A 10/1979 Hache
4,257,488 A * 3/1981 Schnell ..... E02D 13/04 173/133
4,366,870 A * 1/1983 Frederick ..... E02D 13/10 173/131
4,371,041 A * 2/1983 Becker ..... E21B 3/02 173/147
4,439,056 A * 3/1984 Reilly ..... E01C 23/124 173/90
4,989,677 A 2/1991 Lam
5,257,897 A 11/1993 Yamamoto et al.
5,355,964 A * 10/1994 White ..... E02D 7/18 173/1
5,375,664 A * 12/1994 McDowell ..... E02D 7/18 173/1
5,540,295 A * 7/1996 Serrette ..... E21B 1/02 173/49
5,558,469 A 9/1996 Hellerman
5,733,068 A * 3/1998 Reinert, Sr. ..... E02D 7/26 173/184
5,984,587 A 11/1999 Odle
6,000,477 A * 12/1999 Campling ..... E02D 7/10 173/100

(Continued)

*Primary Examiner* — Gloria R Weeks
(74) *Attorney, Agent, or Firm* — Norton Rose Fulbright Canada

(57) ABSTRACT

A hydraulic breaker hammer casing assembly for converting a hydraulic breaker hammer to a pile driving apparatus for driving piles into the ground. A hydraulic breaker hammer is immovably retained in a support housing. The hydraulic breaker hammer is fitted with a blunt working implement for transmitting blows to a drive cap supported on top of a pile. A pile guiding assembly is secured at an open bottom end of the support housing for guiding, in axial alignment with the working implement, the pile being driven in the ground. The casing assembly protects the hydraulic breaker hammer secured therein and provides access thereto as well as displaceable connection to a boom of a pile driving rig.

51 Claims, 14 Drawing Sheets

(56) References Cited

U.S. PATENT DOCUMENTS

| | | | | |
|---|---|---|---|---|
| 6,354,767 | B1 | 3/2002 | Jones | |
| 6,702,037 | B1 * | 3/2004 | Thiessen | E02D 7/10 173/131 |
| 6,749,371 | B2 | 6/2004 | Jones | |
| 6,994,493 | B2 | 2/2006 | Jones | |
| 7,063,172 | B1 * | 6/2006 | Marentette | E02D 5/04 173/13 |
| 7,198,115 | B2 * | 4/2007 | Cardoso | E02D 13/06 173/13 |
| 7,387,173 | B2 * | 6/2008 | Jinnings | E02D 7/10 173/147 |
| 7,422,073 | B2 * | 9/2008 | Hagemeyer | E21B 7/24 173/1 |
| 7,870,910 | B2 * | 1/2011 | Heichel | B06B 1/166 173/142 |
| 2003/0029620 | A1 | 2/2003 | Strand | |
| 2003/0077127 | A1 | 4/2003 | Jones | |
| 2009/0129870 | A1 | 5/2009 | Jones | |
| 2011/0211917 | A1 | 9/2011 | Jones | |
| 2013/0140053 | A1 * | 6/2013 | Niekamp | E02B 7/08 173/93 |
| 2014/0262399 | A1 * | 9/2014 | Cunningham | E04H 17/263 173/133 |

* cited by examiner

HYDRAULIC BREAKER HAMMER CASING ASSEMBLY FOR PILE DRIVING

TECHNICAL FIELD

The present invention relates to a casing assembly for securing a hydraulic breaker hammer for use as a pile driver.

BACKGROUND ART

It is known to drive commercial piles into the ground, these being piles constructed of steel cylinders or solid concrete and having diameters of about 3 to 16 inches. Such piles are normally driven by a dynamic impact of a dead weight or drive hammer applied at the top of the pile. A problem with the prior art pile drivers using dead weights is that these are very heavy weights and they are slow to be retracted along the boom to an upper position whereby to be released onto the top end of the pile with sufficient force to drive the pile into the ground. Such rigs create very large vibrations in the ground and can affect the foundations of adjacent building structures. They can often damage the top end of the pile although an impact block is usually supported on top of the pile but the weight is often not equally distributed about the pile. Such apparatuses are also very noisy.

Another disadvantage of the above pile driving rigs using dead weights is that cranes are required to lift these weights and these cranes are fairly large and are not easily maneuverable, particularly in tight spaces and form this reason these rigs cannot be used when there is insufficient access to a space in which piles are to be drive. These pile driving rigs are very dangerous as the dead weights usually weigh in the area of 7,000 pounds. A disadvantage of such rigs is that there is often cable breakage or breakage of the guide slide of the boom due to the dropping forces created by these heavy impacting dead weights.

A still further disadvantage is that the piles need to have a diameter of at least 7 inches to resist to these high impact blows and therefore such rigs are not utilized for driving smaller diameter piles for supporting foundations of houses or buildings as the blows of these dead weights would break the piles.

SUMMARY OF INVENTION

It is a feature of the present invention to provide a casing assembly for securing a hydraulic breaker hammer for use as a pile driver and which substantially overcomes all of the above-mentioned disadvantages of the prior art.

Another feature of the present invention is to provide a hydraulic breaker hammer casing assembly using a hydraulic breaker hammer for pile driving and wherein the hydraulic breaker hammer is easily installed in the casing and wherein the casing also protects the breaker hammer and its associated hardware.

Another feature of the present invention is to provide a hydraulic breaker hammer casing assembly for pile driving and wherein the breaker hammer is protected by the casing and immovably secured therein and further wherein the casing has a pile guiding assembly secured at an open bottom end thereof to receive the top end portion of a pile therein wherein the impacting working implement of the breaker hammer is maintained axially aligned with the pile.

Another feature of the present invention is to provide a hydraulic breaker hammer casing assembly for pile driving and wherein the pile guiding assembly is adjustable and interchangeable to adapt to piles of different diameters.

Another feature of the present invention is to provide a hydraulic breaker hammer casing assembly for pile driving and wherein the casing assembly is adapted for securement to existing booms of pile driving rigs.

Another feature of the present invention is to provide a hydraulic breaker hammer casing assembly which can be quick-connected on a support carriage displaceable along the boom of a pile driving rig and wherein a downward pulling force may be applied to the casing assembly.

Another feature of the present invention is to provide a hydraulic breaker hammer assembly having an integrated winch for positioning piles thereunder.

Another feature of the present invention is to provide a hydraulic breaker hammer casing assembly for pile driving and which utilizes a blunt working implement and wherein the hammer has fewer parts and therefore requiring fewer and easy repair.

Another feature of the present invention is to provide a hydraulic breaker hammer casing assembly for pile driving and wherein the hydraulic breaker hammer provides approximately 350 blows per minute and wherein the coupling between the blunt working implement and the breaker hammer is more rigid and therefore can better handle lateral loads during operation.

Another feature of the present invention is to provide a hydraulic breaker hammer casing assembly wherein the impacting blows are transmitted to the top of the pile through a blow damping drive cap having a fluid chamber and fluid pressure monitoring means to measure the impact force of the blows and through fluid pressure monitoring means determining the hardness of the ground by measuring the resistant force of the pile which provides a means to determine when a pile has reached a substrata to provide the required support, such as the bed rock.

A still further feature of the present invention is to provide a quick interlocking means between the hydraulic breaker hammer casing assembly to a slide plate or carriage displaceable along a boom whereby the hydraulic breaker hammer housing can be quickly coupled and uncoupled to the boom.

According to the above features, from a broad aspect, the present invention provides a hydraulic breaker hammer casing assembly for converting a hydraulic breaker hammer to a pile driving apparatus. The casing assembly comprises a support housing having breaker hammer securing means adapted for immovably securing therein a hydraulic breaker hammer. The support housing has protective side walls. One of the protective side walls has attachment means for connection to a support member displaceable along a boom of a pile driving rig. An impact shaft of the hydraulic support hammer is positioned near a bottom end of the support housing. A pile guide means is secured at the open bottom end of the support housing for guiding, in axial alignment with the impact shaft, a pile to be driven in a soil surface.

According to a still further broad aspect of the present invention there is provided an adjustable pile guide housing for displaceable securement under a drive cap seated on a top end of a pile and impacted by a pile driver. The adjustable pile guide housing is a rectangular open-ended housing having opposed top and bottom flat walls and a pair of parallel side walls. A large opening is provided in the top and bottom flat walls and aligned with one another and dimensioned for the passage of a top end portion of a pile to be received therethrough. A pair of slide guide blocks is retained captive in the open-ended housing by obstruction means secured to the open-ended housing and obstructing the open end of the housing. Adjustable securement means is provided for securing the slide guide blocks at predetermined locations on a respective side of the pile guide housing. The slide guide blocks have a shaped formation in an inner wall thereof facing one another on opposed sides of the large opening.

According to a still further broad aspect of the present invention there is provided a blow damping drive cap in combination with a pile driving hammer for transmitting impact forces from the pile driving hammer. The drive cap has a fluid chamber and a fluid conduit leading to the fluid chamber. Fluid pressure monitoring means is secured to the fluid conduit to measure the impact force of the impact blows transmitted to the pile in relation to the hardness of the ground in which the pile is driven. The fluid pressure monitoring means determines the hardness of the ground by the measured resistance force of the pile.

BRIEF DESCRIPTION OF DRAWINGS

A preferred embodiment of the present invention will now be described with reference to the accompanying drawings in which.

DESCRIPTION OF PREFERRED EMBODIMENTS

Figure 2:
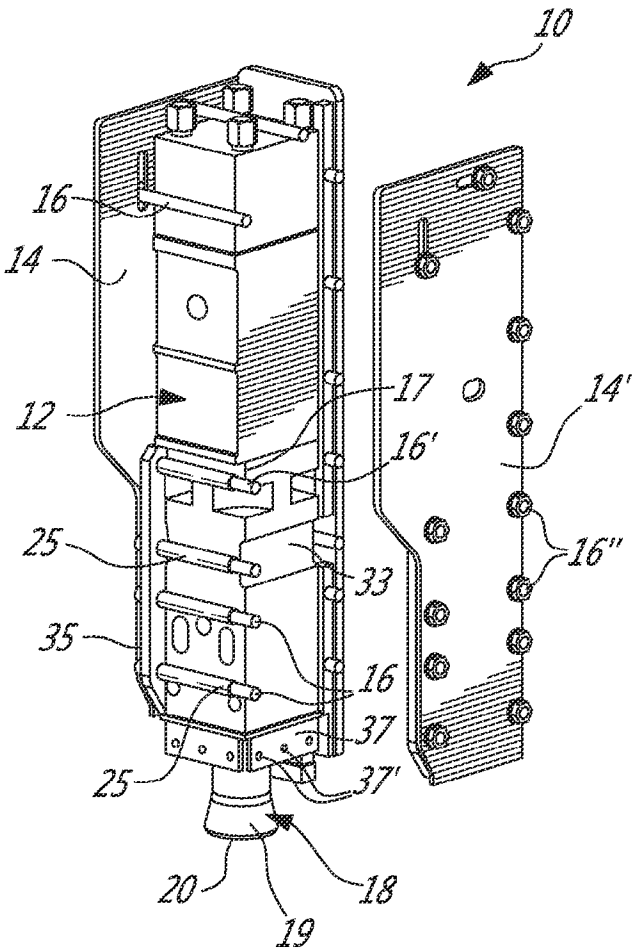
FIG. 2 is an exploded perspective view showing how the hydraulic breaker hammer is secured in the support housing.
Figure 1:
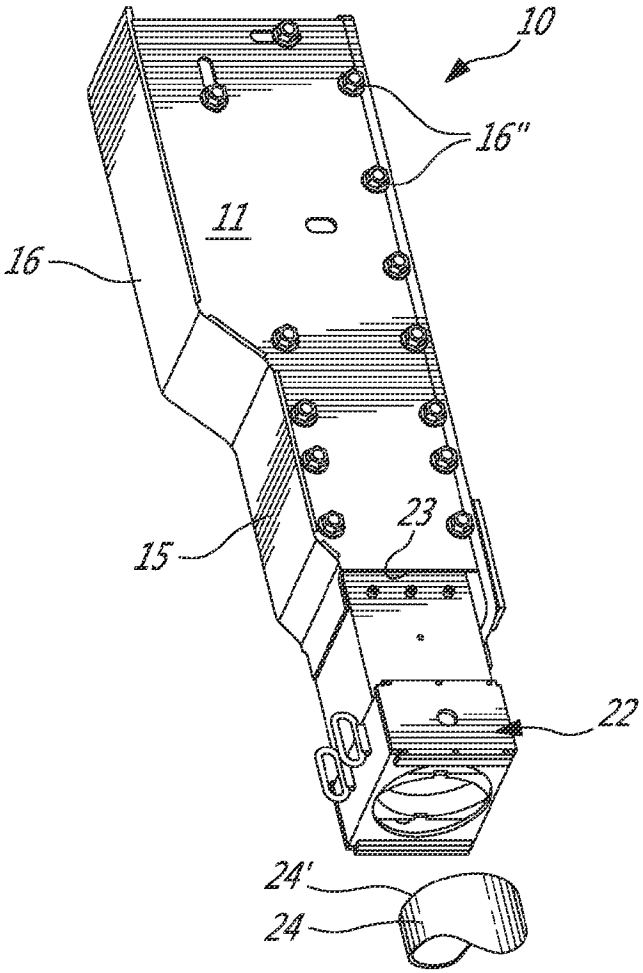
FIG. 1 is a perspective view illustrating the hydraulic breaker hammer casing assembly.

Referring now to the drawings and more particularly to FIGS. 1 to 5, there is shown generally at 10 an embodiment of the hydraulic breaker hammer casing assembly of the present invention. The casing assembly 10 comprises a support housing 11 which is adapted for immovably securing therein a hydraulic breaker hammer 12 as shown in FIG. 2. The hydraulic breaker hammer is of the type used on backhoes to break concrete wherein the working implement is of large diameter of at least one inch. The support housing has a rear support wall 13, opposed lateral side walls 14 and 14' and a front wall 15. A door 16 is provided at the top end of the front wall for access to the interior of the support housing 11.

Figure 3:
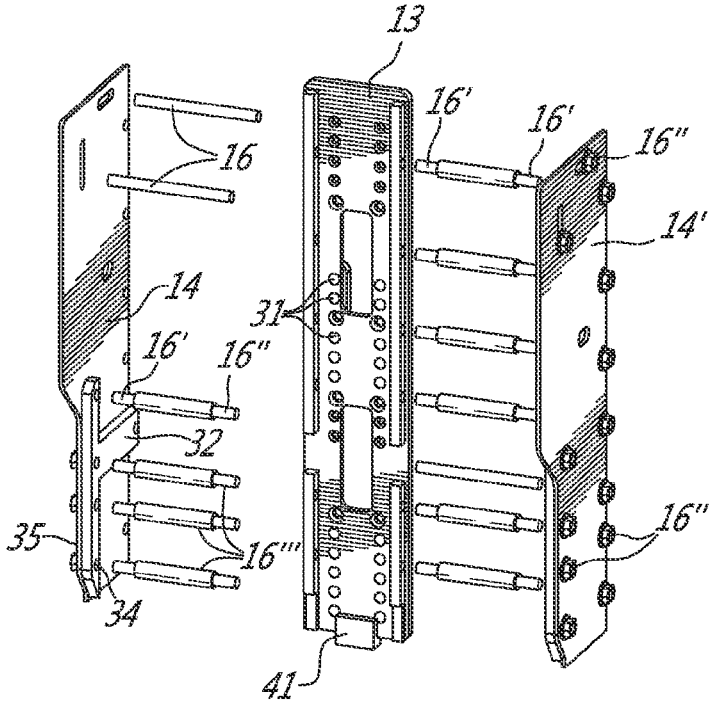
FIG. 3 is an exploded perspective view showing the construction of the housing with the front wall having been removed.
Figure 4:
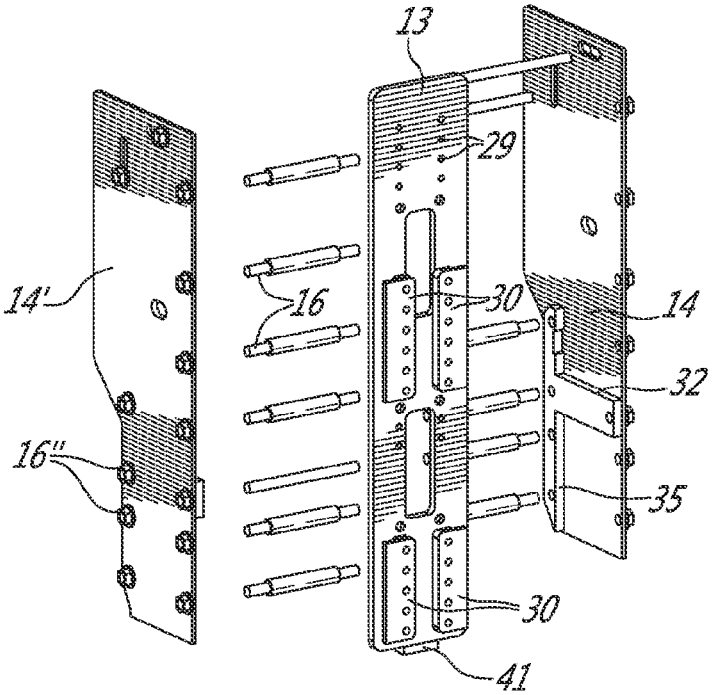
FIG. 4 is an exploded rear perspective view of FIG. 3.

As shown more clearly in FIGS. 2 to 4, a plurality of connecting rods 16 are secured at predetermined positions between the opposed lateral side walls 14 and 14' for clampingly securing the hydraulic breaker hammer 12 in the support housing 11. The connecting rods 16 are threaded at both ends 16' and adjustably secured by nuts 16". At least some of these connecting rods 16, such as rod 16' are disposed in close contact in transverse recess areas of the hydraulic breaker hammer 12, such as recess areas 17, for preventing axial displacement of the hydraulic breaker hammer 12 in the support housing 11. Connecting rods 16 could also be secured between the front and rear wall of the housing.

Figure 5:
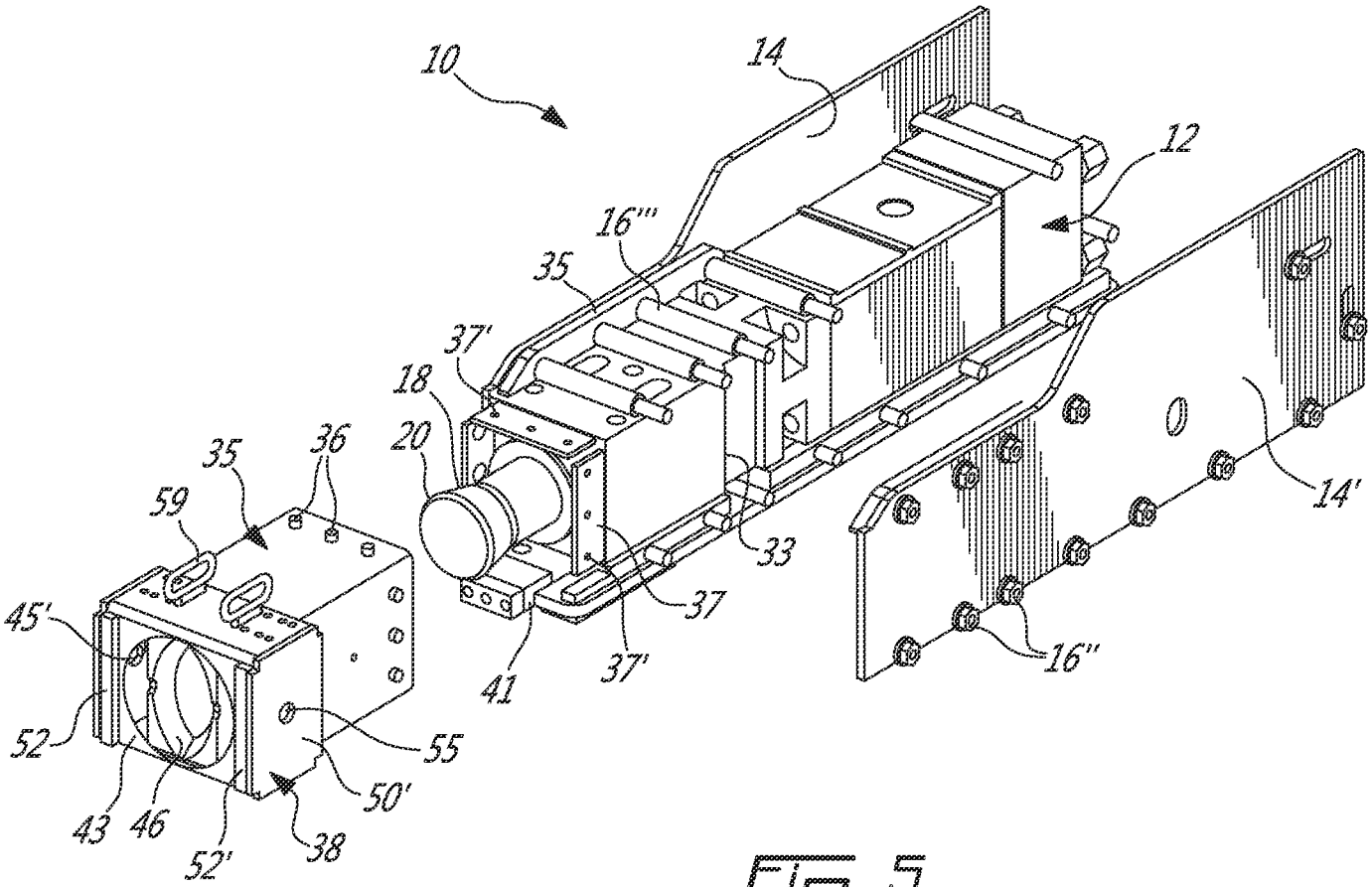
FIG. 5 is an exploded perspective view showing the hydraulic hammer casing assembly including the pile guiding assembly secured to the lower end of the casing assembly.

As shown in FIGS. 2 and 5, the hydraulic breaker hammer 12 is fitted with a blunt steel working implement 18 which has a large flared end section 19 which has a convex outer surface 20 for delivering impacts to a drive cap 21 (see FIG. 7) guidingly received in a pile guiding assembly 22 secured at an open bottom end 23 of the support housing 11 for guiding, in axial alignment with the working implement 18 a pile 24 (see FIG. 1) to be driven into the soil. The drive cap 21 has a concave upper surface.

As shown in FIGS. 2 to 5, some of the connecting rods 16 are provided, in at least major sections thereof, with a sleeve 25 of compressible material, such as rubber, to protect the rods from direct frictional contact with the hydraulic breaker hammer and these sleeves 25 dampen vibrations between the hammer and the frame and reduce noise. As more clearly illustrated in FIGS. 3 and 4, the rear support wall is provided with attachment means for securing the casing assembly 10 to a pile driving apparatus, not shown but obvious to a person skilled in the art. The attachment means is herein constituted by slide engaging sleeves 30 secured to an outer surface 29 of the rear support wall 13 for sliding engagement with a carriage of a mast of a pile driving apparatus. Connection means in the form of a series of holes 31 are provided in the rear support wall 13 to provide adjustable attachment connections of the breaker hammer casing assembly on a mast.

As illustrated in FIGS. 2 to 4, recess engaging plates 32 are also secured to connecting rods, herein connecting rod 16''' whereby to dispose these recess engaging plates 32 in transverse recess areas such as area 33, as shown in FIG. 5, of the hydraulic breaker hammer 12 and extending between the front wall 15 and the rear support wall 13. These rods 16''' also have threaded ends and extend in close sliding fit through holes 34 provided in the transverse recess engaging plates 32, herein a front transverse arm 35 thereof, and are secured by nuts 16''.

Figure 6:
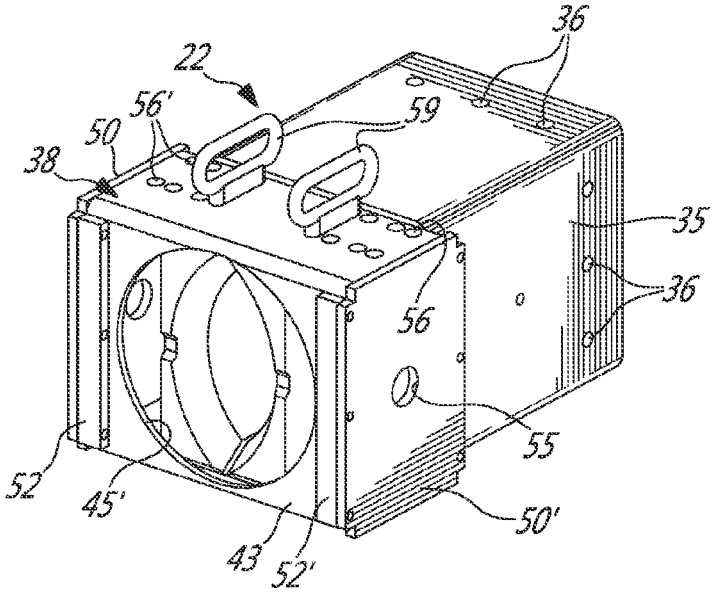
FIG. 6 is a perspective view of the pile guiding assembly.
Figure 7:
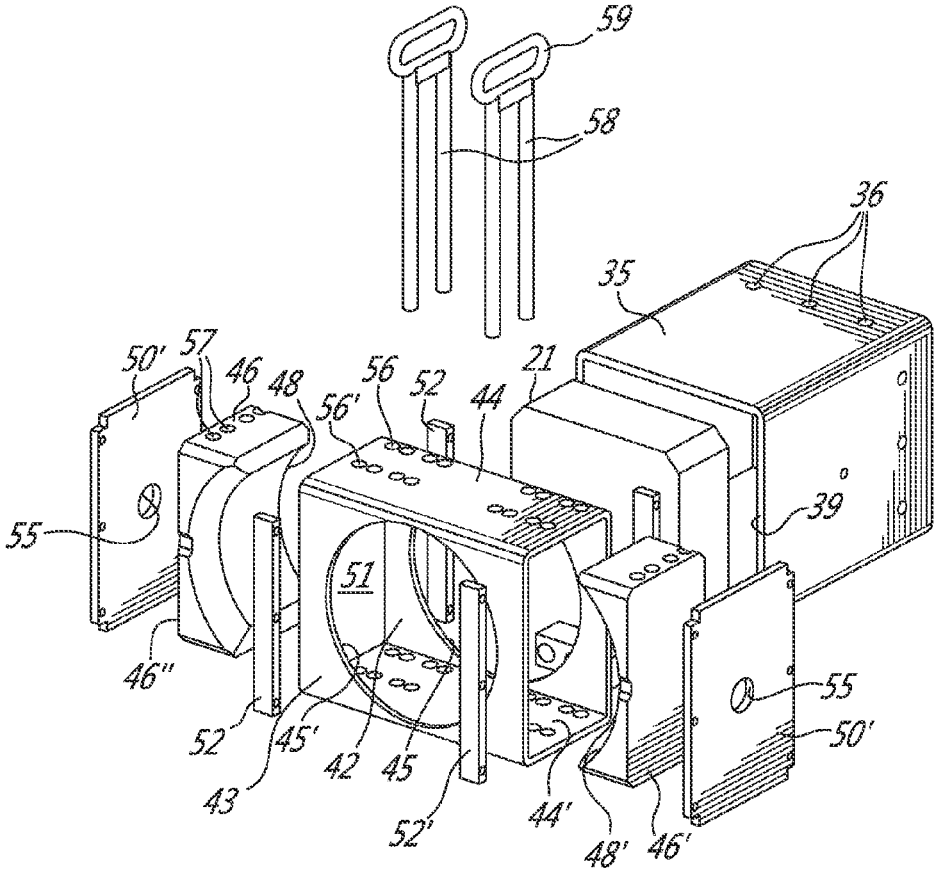
FIG. 7 is an exploded perspective view of the pile guiding assembly.
Figure 8:
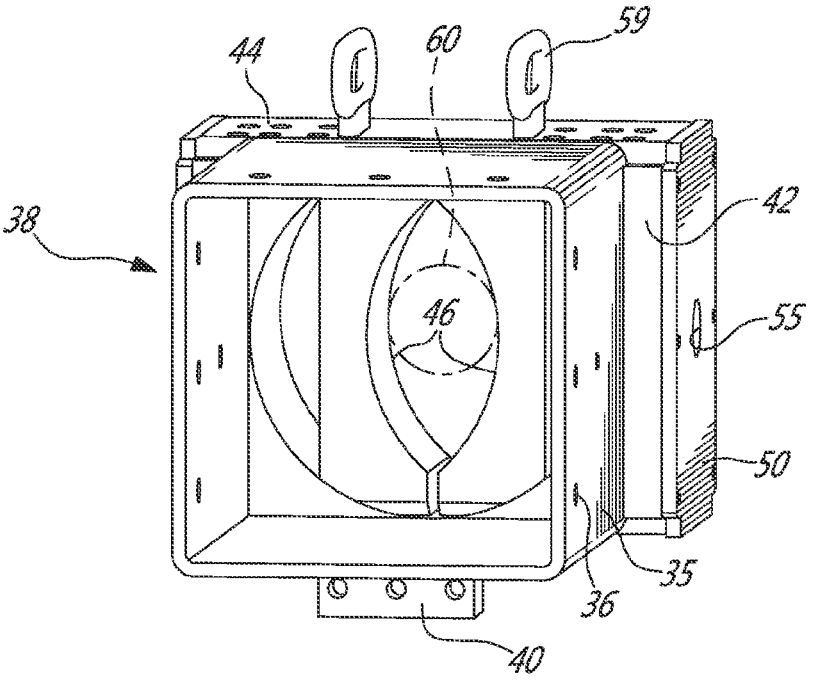
FIG. 8 is a rear perspective view of the pile guiding assembly and illustrating the slide guide blocks in a completely closed position.

With reference now to FIGS. 6 to 8, there will be described the construction and operation of the pile guiding assembly 22. The pile guiding assembly comprises an attachment cylinder 35 which is herein shown as a square cross-section steel cylinder provided with holes 36 spaced apart along its outer rear periphery for securement to an attachment means in the form of a square bracket 37 secured about the bottom end of the hydraulic breaker hammer 12 or to the bottom end of the support housing 11 and supporting the pile guiding assembly in position to align the top end of a pile, such as the pile 24 shown in FIG. 1, axially with the longitudinal axis of the hammer and the working implement 18. A drive cap 21 is disposed in sliding fit in the attachment cylinder 35 (see FIG. 7) and extends transversely therein. The drive cap 21 is in the shape of a square block and it has a top concave surface (not shown) to receive therein the convex end 20 of the working implement 18 (see FIG. 5) whereby to transfer impact blows to the circumferential top end 24' of the pile cylinder 24 to be driven into the soil (see FIG. 1). The drive cap 21 ensures perfect sitting on the top end 24' of the pile.

An adjustable pile guide housing 38 is secured adjacent the front open end 39 of the attachment cylinder 35 and therefore is secured to the support housing 11 for seating engagement about the top end portion of the pile 24 whereby to orient the hydraulic breaker hammer support housing axially aligned with the pile and with the anvil sitting on the top end of the pile as mentioned above. The square bracket 37 is provided with holes 37' for receiving fasteners for connection with the holes 36 in the attachment cylinder whereas the adjustable pile guide housing 38 is fitted with a projecting flange 40 secured along a lower edge thereof for connection with a connecting flange 41 secured to the bottom end of the rear support wall 13 of the support housing 11.

The adjustable pile guide housing 38 is a rectangular open-ended housing having opposed top and bottom flat walls 42 and 43, respectively, and a pair of parallel transverse or side walls 44 and 44'. Large openings 45 and 45', herein of circular shape and greater than the largest diameter pile to be received therein, are provided in the top and bottom flat walls 42 and 43, respectively. These large openings are aligned with one another. A pair of slide guide blocks 46 and 46' is retained captive in the open-ended housing 38 and slidable therein. As hereinshown, the guide blocks 46 and 46' have shaped inner walls, herein an arcuate shaped formation in inner walls 48 and 48' thereof and disposed in facial relationship to one another on opposed sides of the large openings 45 and 45'. The inner wall 48 has a width sufficiently large for retention contact with the opposed outer arcuate surfaces of a pile received therebetween whereby to maintain good facial contact therewith to align the hydraulic breaker hammer casing assembly axially with the pile. These guide blocks 46 and 46' are retained captive within the housing 38 by end walls 50 and 50' secured over the open ends 51 and 51' of the housing 38. Brackets 52 and 52' provide attachment of the end walls 50 and 50' to the top and bottom walls 42 and 43. As shown, the end walls are also provided with a central hole 55 to provide access to the rear flat wall 46'' of the guide blocks disposed adjacent thereof whereby a rod can be positioned therein to move the guide blocks for adjusting their position or for dislodging them if the are arrested by debris, such as dirt, infiltrated in the housing 38.

The guide blocks 46 and 46' are adjustably secured within the housing 38 by means of two or more rows of aligned holes, herein rows 56 and 56' which are provided in both the side walls 44 and 44' and aligned with one another. The guide blocks are also provided with through bores 57 extending across the slide guide blocks and disposed for alignment with selected ones of the two or more holes in the rows of holes 56 and 56' in adjacent ones of the rows. Connecting rods 58 are disposed in selected ones of the holes and the aligned through bores 57 for securing the slide guide blocks at a predetermined location for guided contact with the outer side wall of a pile to be received in the adjusting pile guide housing 38.

As shown in FIG. 7, the connecting rods 58 are provided as a pair of connecting rods interconnected in parallel relationship at an end thereof with a handle 59 formed at the connected end for ease of inserting and withdrawing the connecting rods from the selected ones of pair of holes 56 and through bores 57.

FIG. 8 illustrates the slide guide blocks 46 and 46' positioned and secured at their innermost positions whereby to guidingly position a small diameter pile as herein identified by phantom lines 60.

Although the pile guiding housing 38 herein illustrated is for guiding pile tubes of circular cross-section, they may be configured to guide piles of different cross-sections, such as square cross-sections. Therefore, the openings 45 and 45' would be square and the inner walls 48 and 48' of the guide blocks 46 and 46' would be straight inner walls.

Figure 9A:
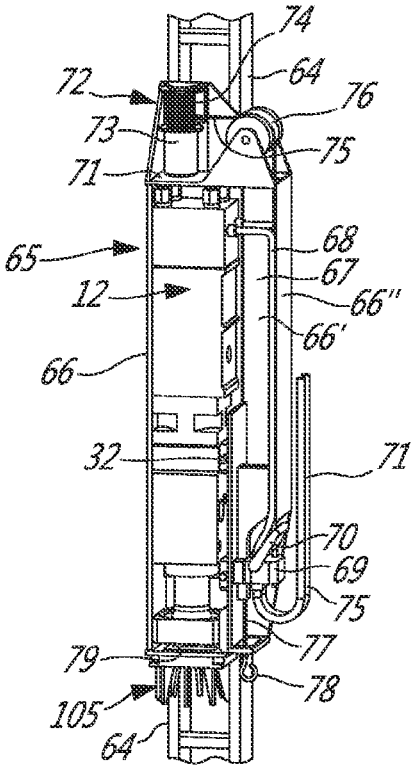
FIG. 9A is a further embodiment of the hydraulic breaker hammer casing assembly and wherein a protective space is defined by the side walls of the support housing to accommodate hydraulic and electrical lines and wherein these lines are quickly connectable and disconnectable from the breaker hammer assembly.
Figure 9B:
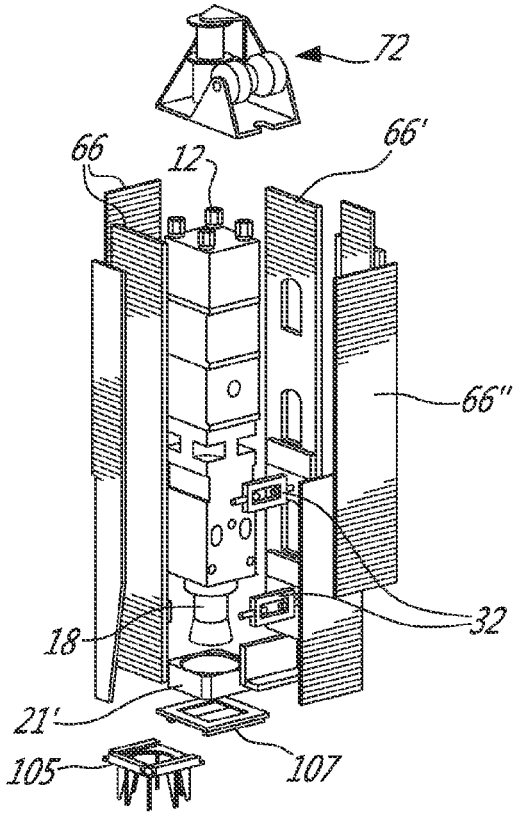
FIG. 9B is an exploded view of the hydraulic breaker casing assembly of FIG. 9A.
Figure 17A:
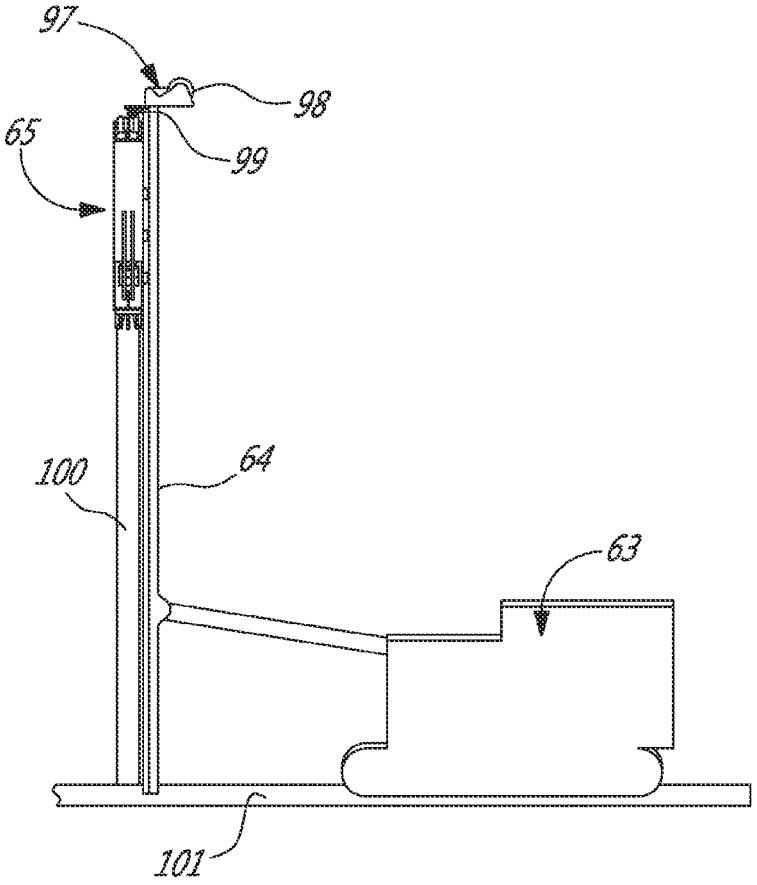
FIG. 17A is a simplified side view showing the hydraulic breaker hammer casing assembly supported on a boom by a winch and pulleys secured to the top end of the support housing.

Referring now to FIGS. 9A and 9B, there is shown a further embodiment of the hydraulic breaker hammer casing assembly herein denoted by reference numeral 65. As hereinshown the housing assembly comprises protective side walls for housing the hydraulic breaker hammer 12 and suitable retention means is provided for maintaining the hydraulic breaker hammer 12 immovable therein and such retention means may be similar to that as described in relation to FIGS. 3 and 4 and including such retention means as the recess engaging plates 32. As hereinshown, the protective side walls are substantially flat rectangular plates with one of the side walls 66' constituting a rear side wall having attachment means for connection to the boom 64 of a pile driving rig 63 as schematically illustrated in FIG. 17A. A side wall 66" is herein shown spaced from the hydraulic breaker hammer 12 whereby to create a protective space on a side of the hydraulic breaker hammer to accommodate hydraulic and electrical lines 68 therein. These hydraulic and electrical lines 68 are connected to a connection block 69 connected to a lower side section of the support housing. Connector mechanisms actuated by a connecting arm 70 quick-connect an disconnect the internal hydraulic lines and electrical wires 68 to external flexible supply conduits 71 in which the hydraulic lines and electrical lines or other lines are housed for interconnection with the internal hydraulic and electrical supply lines 68.

Figure 10:
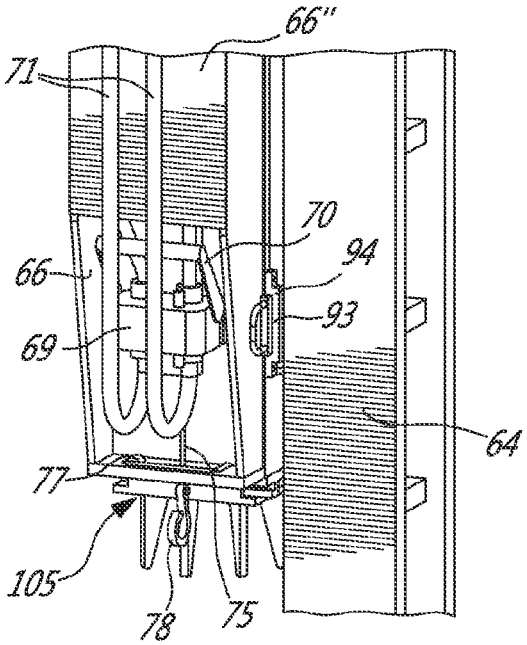
FIG. 10 is an enlarged view illustrating the construction of the connecting block for connecting and disconnecting the hydraulic and electrical conduits as well as illustrating the securement of a pile guide member at the bottom of the housing and a winch hook to attach to piles to be positioned under the casing.

As hereinshown with additional reference to FIG. 10, the support housing also has a top wall 71 with a cable winch assembly 72 mounted thereon. The winch assembly comprises a motor 73 which drives a spool 74 on which a steel wire 75 is stored. The steel wire 75 is guided on a pulley 76 and extends downwardly into the protective space 67 and is guided at a bottom end in a guide bracket 77. A hook 78 is secured to the free end of the cable 75. This cable winch assembly is provided whereby the cable 75 may be attached to a pile top end portion lying on the ground for lifting the pile and guiding the top end portion of the pile under the open bottom end 78 of the housing by displacing the support housing upwardly along the boom to draw the top end of the pile in position under the open bottom end of the casing. Accordingly, there is no need for other equipment to position the piles under the housing.

With reference now to FIGS. 11A to 13, there will be described the attachment means for securing the support housing 75 to the boom 64 of a pile driving rig. As hereinshown, the attachment means is constituted by a slide plate 80 which has two or more aligned first connecting members herein constituted by seating blocks 81, as better seen in FIG. 12, three of which are axially aligned on the slide plate 80, and second axially aligned connecting members secured or formed in the rear side wall 66' of the support housing 65. The second connecting members are constituted by spaced-apart connecting cavities 82, three of which are provided on the rear wall 66' of the housing and disposed axially aligned and spaced-apart whereby to receive therein the first connecting members for inter-engagement therein wherein the flat surface 66'" of the rear wall 66' of the housing will sit flush on the outer flat wall 80' of the slide plate 80.

Figure 12:
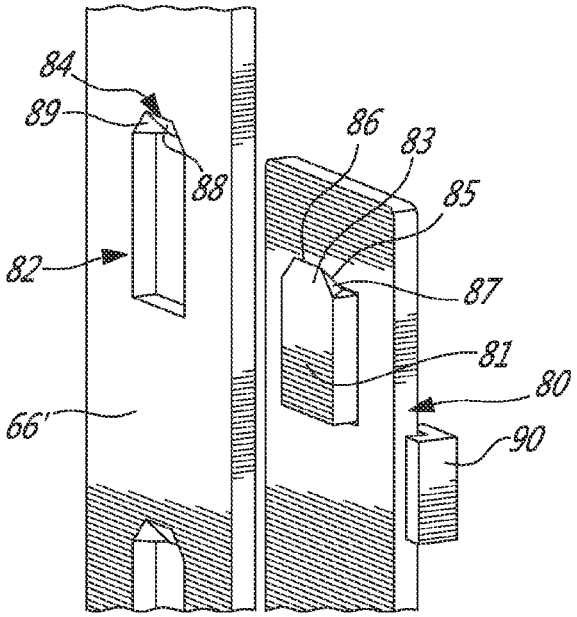
FIG. 12 is an enlarged perspective view of the configuration of the quick connectors of the support housing and the slide plate, namely the connecting cavities and the tongue formations.

As shown in FIG. 12, each of the seating blocks 81 has a tongue formation 83 extending outwardly at a top end thereof. The connecting cavities 82 are provided in a top edge thereof with a tongue engaging formation 84 for seating engagement on the tongue formation 83 of an associated one of the seating blocks 81. The tongue formation 83 of the seating block has an angulated flat slide ramp section 85 which extends form a free outer edge 86 to the flat surface 80' of the slide plate. It is also provided with opposed slope side edges 87 which extend angularly inwards from the flat surface 80' to the free outer edge 86 of the tongue. The tongue formations guide the seating blocks 81 for inter-engagement with their associated connecting cavities 82. As also better shown in FIG. 12, the tongue engaging formation 84 of the connecting cavities is constituted by an inward upwardly sloping seating wall 88 for sliding engagement on the flat slide ramp 85 of the tongue formation 83 of its associated seating blocks. It also has opposed angularly and inwardly sloping guide edges 89 which extend from opposed edges of the connecting cavities to the seating wall 88. Accordingly, when the seating blocks 81 are disposed within the connecting cavities 82, the tongue formations will pull in the rear wall 66' of the support housing 65 as the housing is lowered on the slide plate 80.

Figure 11A:
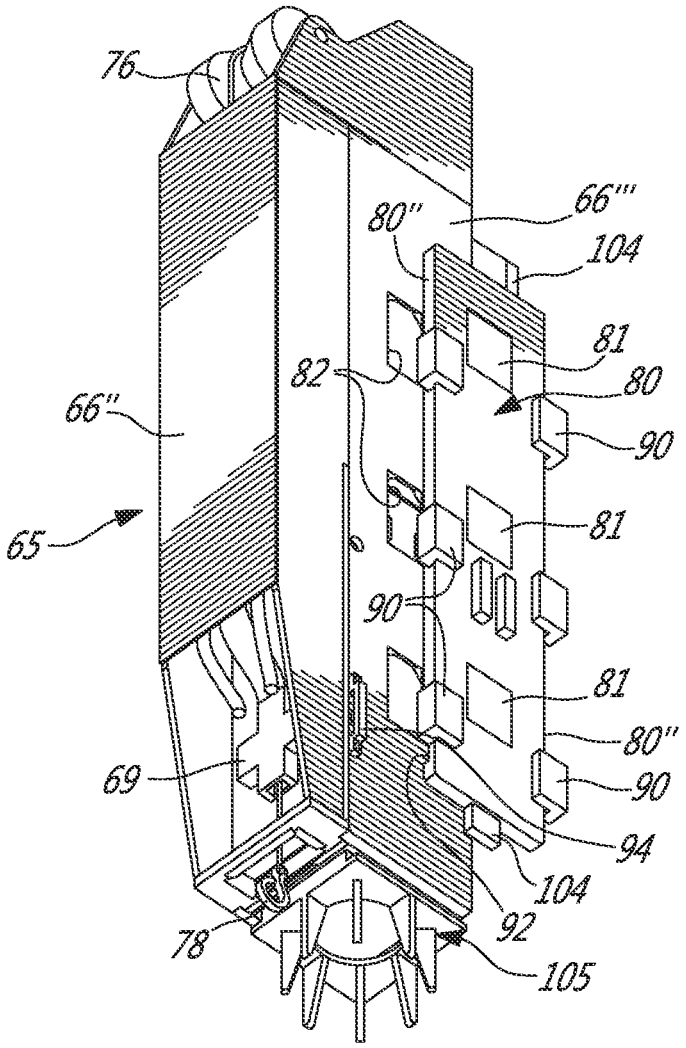
FIG. 11A is a further bottom side view of the further embodiment of the hydraulic breaker hammer casing assembly showing its connection to a slide plate for quick connection and disconnection to a boom of a pile driving rig.
Figure 13:
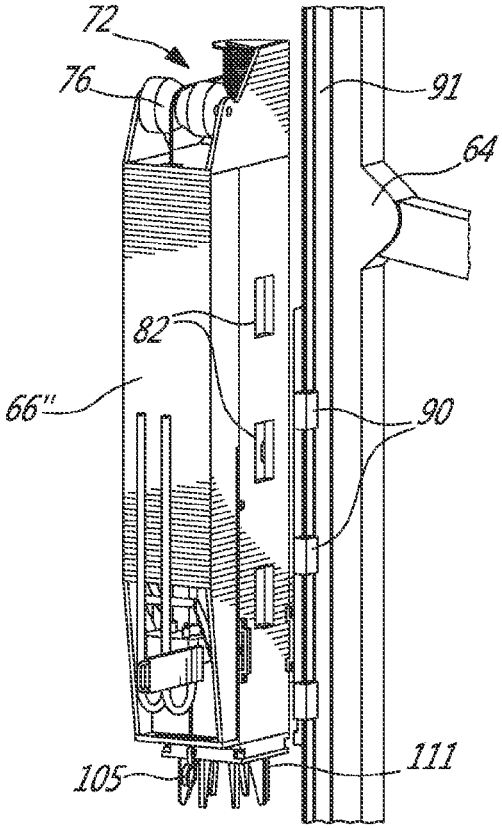
FIG. 13 is a perspective view illustrating the support housing secured to a boom of a pile driving rig for sliding displacement therealong.

The slide plate 80, as better shown in FIG. 11A, is provided with boom engaging guide means in the form of rearwardly extending slide arms 90 extending from opposed side edges 80" of the slide plate whereby to retain the slide plate in sliding captive engagement with opposed rails 91 of the boom 64, as shown in FIG. 13. Accordingly, the support housing is slidingly retained and displaceable upwardly and downwardly along the boom by a displacing means in the form of a cable or chain drive as will be described later. In order to prevent the slide plate 80 from being disconnected from the support housing 65, a transverse slot 92 is formed in the flat surface 80' of the slide plate 80, and a flat rectangular slide plate 93 is guidingly disposed in captive retention between guide brackets 94 formed on opposed sides of the rear wall 66' of the housing whereby the flat lock bar 93 may be disposed in interlocking slide fit with the transverse slot 92 to prevent disengagement of the tongue engaging formations within the connecting cavities by preventing axial displacement between the slide plate 80 and the rear wall 66 of the housing.

Figure 17B:
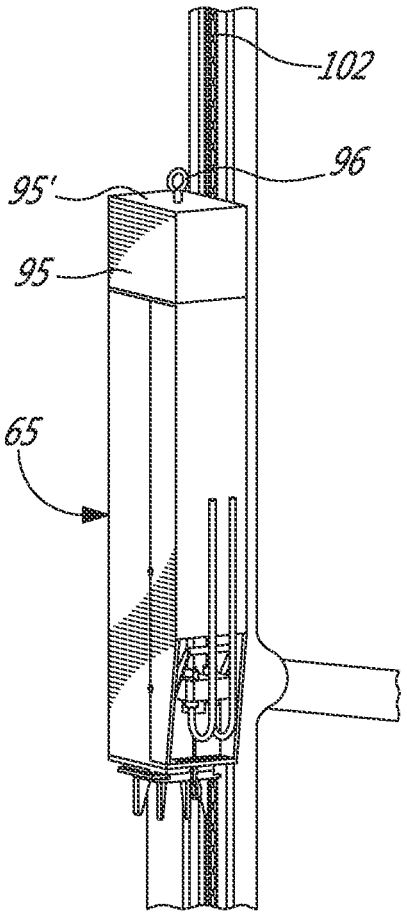
FIG. 17B is a perspective view showing the hydraulic breaker hammer casing assembly secured to the boom of a pile driving rig by means of a chain drive wherein a downward force may be applied to the support housing by the chain drive to assist in the downward driving force of the hydraulic breaker hammer.

It is pointed out that at least one of the side walls 66 of the housing is a removable side wall to provide access to the hydraulic breaker hammer and the protective space to provide for maintenance to the casing assembly and the hydraulic breaker hammer. The protective housing also protects the assembly and the hydraulic breaker hammer from foreign elements and adverse climatic conditions such as rain and snow. Further, as shown in FIG. 17B, the top wall of the housing may be provided with a further protective housing 95 to protect the winch assembly 72 therein. That further protective housing 95 may also be provided with an attachment 96 secured to a top wall 95' of the housing 95 whereby a winch cable 97 (see FIG. 17A) of a motor driven winch 98 may be secured. As shown in FIG. 17A, the motor driven winch 98 is mounted at a top end 99 of the boom 64 whereby to position the breaker hammer casing assembly 65 at a top end of the boom with a pile 100 positioned thereunder to be driven into the ground surface 101 by impact blows generated by the hydraulic breaker hammer and the total weight of the hydraulic breaker hammer casing assembly.

Figure 15:
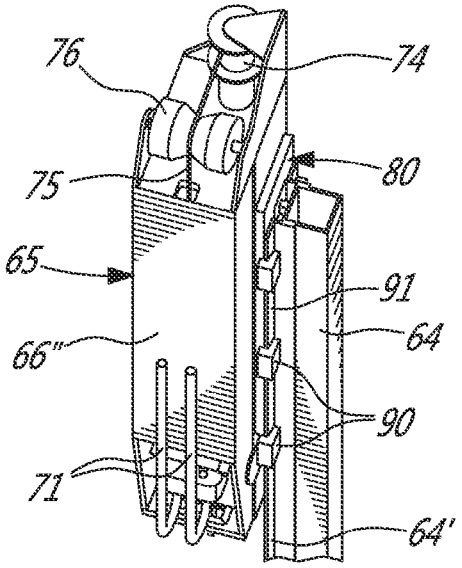
FIG. 15 is a top perspective view of the hydraulic breaker hammer casing assembly illustrating again the sliding interconnection of the housing with the boom and wherein the casing assembly can be displaced above the top end of the boom and further illustrating some component parts of the pile winch assembly.
Figure 18A:
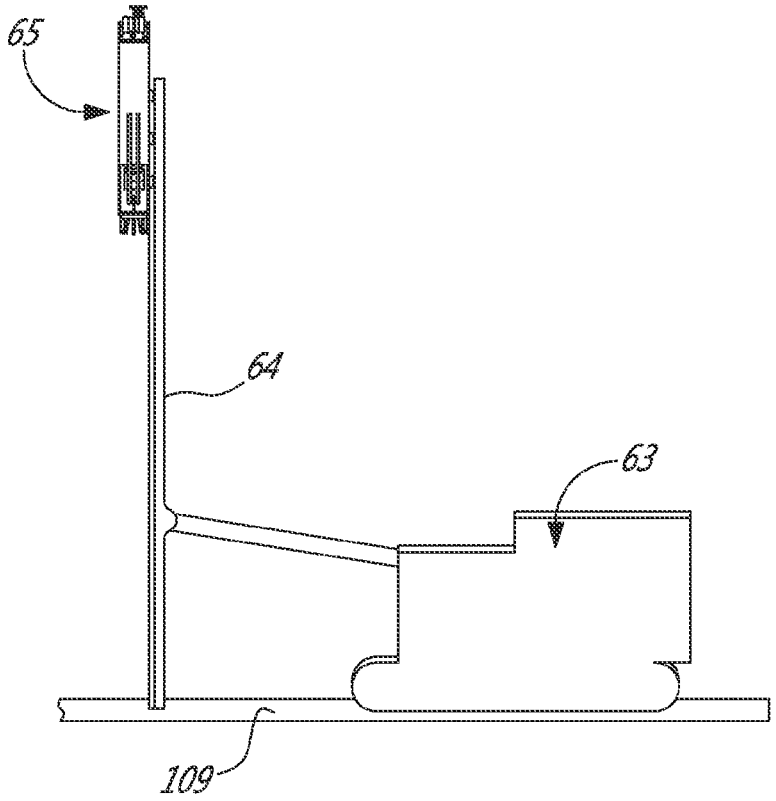
FIG. 18A is a simplified side view showing the top position of the support housing when slidingly displaceable along the boom by a chain or cable drive and wherein the housing exceeds the top end of the boom thereby permitting the booms to be constructed shorter or providing for the positioning of longer piles under the hydraulic breaker hammer casing assembly.
Figure 18B:
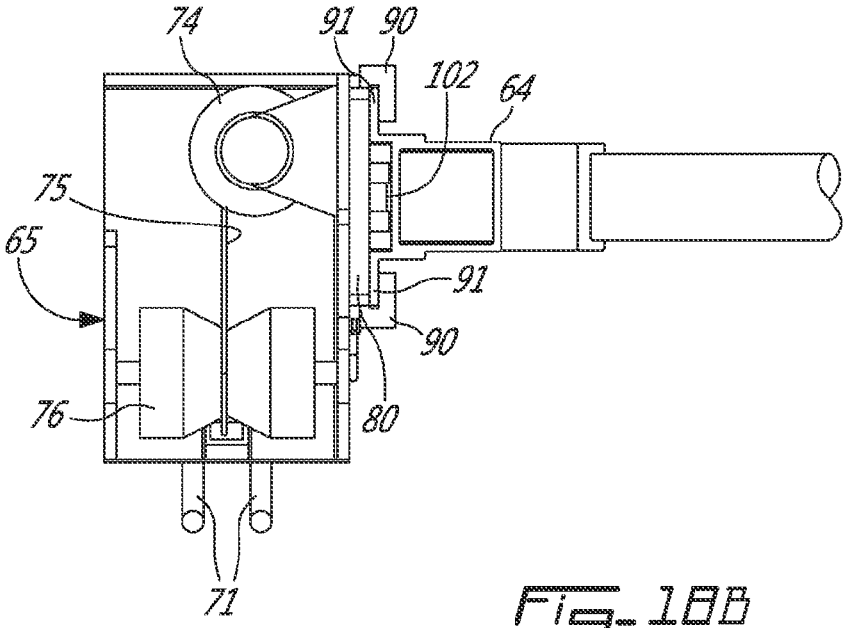
FIG. 18B is an enlarged view showing the top end of the casing assembly when slidingly connected to the boom and displaceable by a chain drive.

With further reference to FIGS. 17B, 18A and 18B, there is illustrated the hydraulic breaker hammer casing assembly 65 secured to a drive attachment tether herein constituted by a link chain 102 guided by sprockets and a drive motor whereby to impart an upward pulling force and a downward pulling force on the housing 65 to position the pile driving assembly 65 at a top end of the pile to be driven into the soil surface and to provide a downward pulling force on the hydraulic breaker hammer casing assembly 65 when the hydraulic breaker hammer generates impact blows whereby to provide additional driving force at the top end of the pile as shown in FIG. 11A. Slide plate 80 is provided with U-shaped hooks 104 at opposed ends thereof whereby the link chain 102 may be secured thereto. Other securement means may also be provided to secure the slide plate to the link chain 102. As can be seen from FIGS. 15 and 18A, with this type of attachment means the hammer casing assembly 65 may be drawn to the top end of the boom 64 with the housing partly projecting over the top end of the boom and this provides for the booms to be constructed of shorter length to accommodate piles of standard size or may also provide for the driving of longer pile lengths with the same boom length.

Figure 11B:
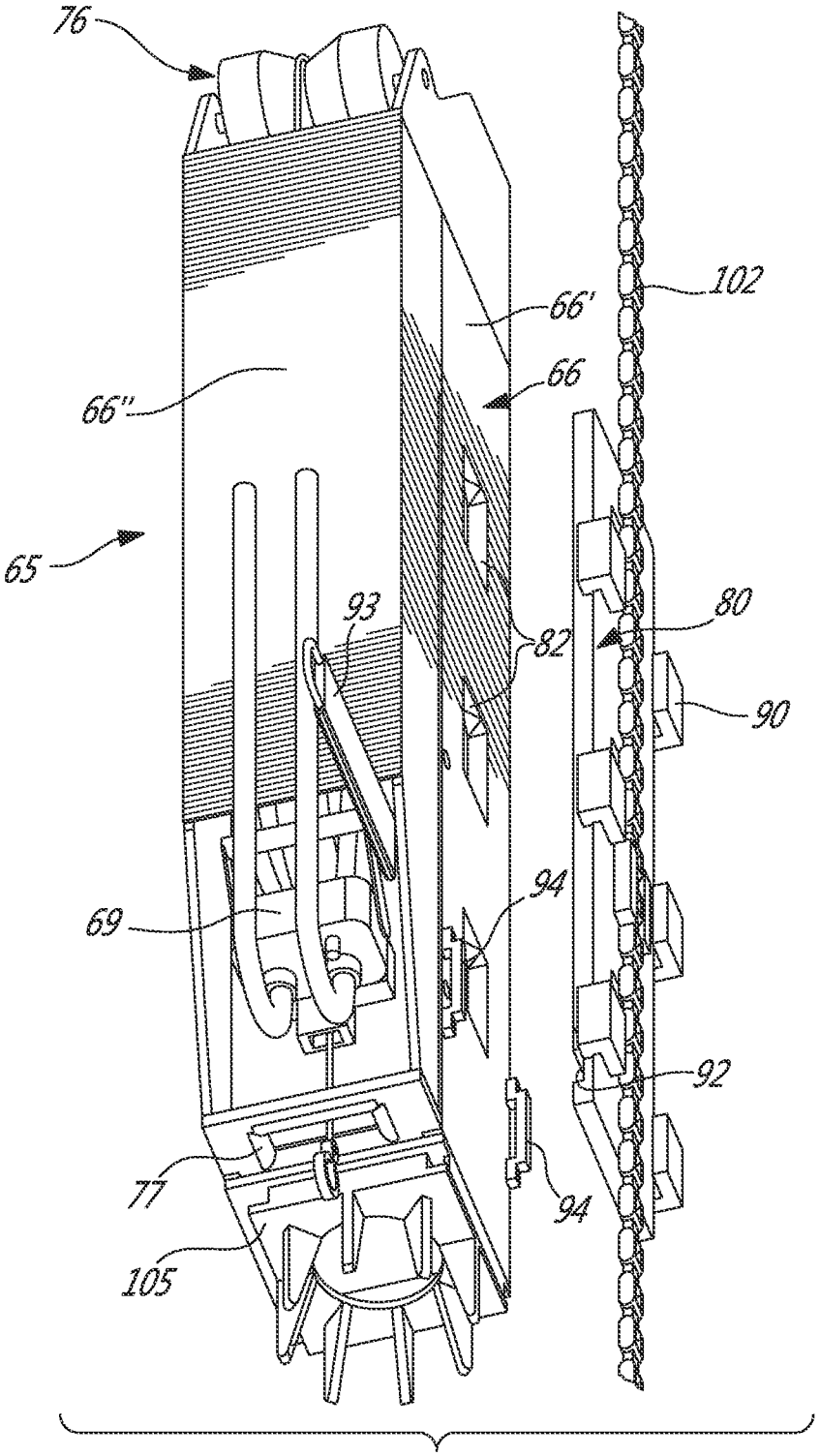
FIG. 11B is a view similar to FIG. 11A but seen from a different angle.
Figure 14C:
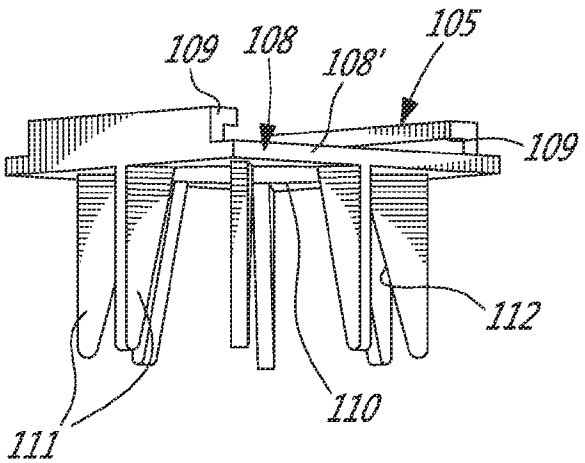
FIG. 14 is an exploded view showing the removable interconnection of the pile guides to the bottom open end of the support housing and herein illustrating two different types of pile guides.
Figure 14B:
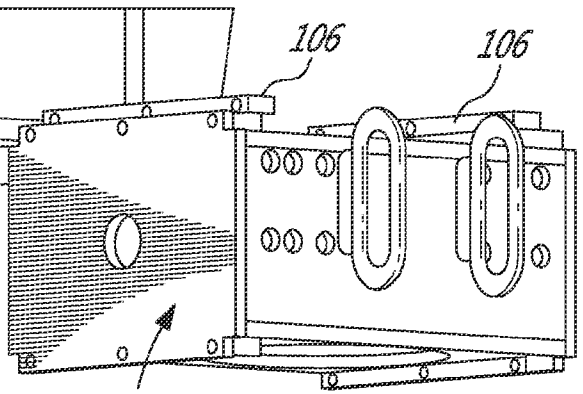
Figure 14A:
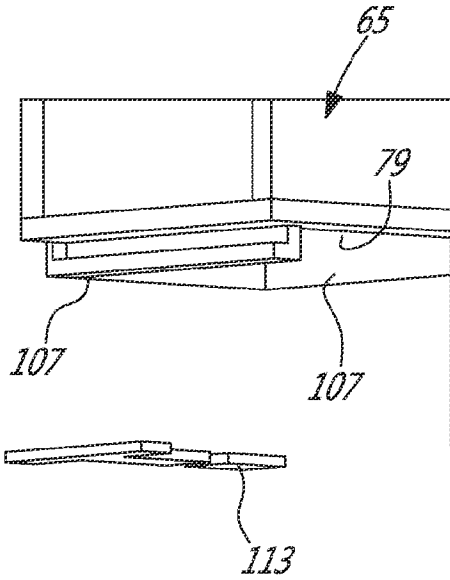

Referring now to FIG. 14 and additionally to FIG. 10 and FIGS. 11A and 11B, there will be described the detachable attachment of the pile guides 38 and 105 to the bottom open end 79 of the housing 85. As hereinshown the adjustable pile guide housing 38 is provided with a pair of parallel guide flanges 106 secured on a top surface of its support frame for removable engagement with the pair of guide flanges 107 projecting from a lower surface of the support housing for guiding sliding engagement therewith. As shown in FIG. 14, there are two types of pile guides and other types are envisaged for guiding piles of different configurations under the open end 79 of the support housing 65. Flat corrugated retention piles can also be adapted.

The pile guide 105 comprises a support frame 108 provided with a pair of parallel guide flanges 109 secured on a top surface of the support frame 108 for removable engagement with the slide flanges 107 of the support housing 65. A pile passage 110 is defined between the pair of guide flanges 109 and configured to receive a pile in close sliding fit therein. A plurality of depending guide fingers 111 are secured to a lower surface of the support frame 108 and spaced-apart about the pile passage 110. The finger members 111 have an inner angulated guide edge 112 sloping outwardly from about the pile passage 110 to an outer end thereof to create an enlarged guide opening to capture a top end portion of a pile to guide it into the pile passage 110. These fingers 111 constitute a pile guide means. As shown in FIG. 10, a connecting pin 113 retains the pile guides secured about the open bottom end of the casing 65. Other connecting means are also envisaged. As shown in FIG. 14, the connecting pin 113 extends through a connecting opening 114 formed in each of the slide flanges 107 and extend in front of the guide flanges 106 which as shown in the slide guide 104 is recessed from a front edge 108' of the frame 108.

Figure 16A:
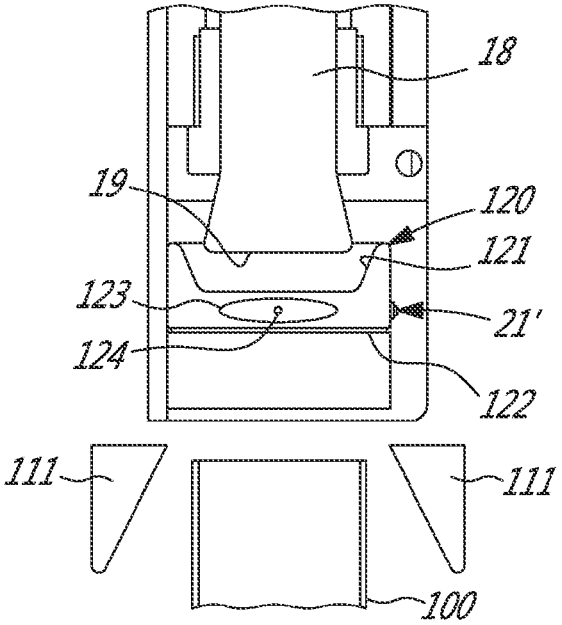
FIG. 16A is a section view showing the construction of the blow damping drive cap and the blunt end of the impact shaft of the hydraulic breaker hammer in relation thereto.
Figure 16B:
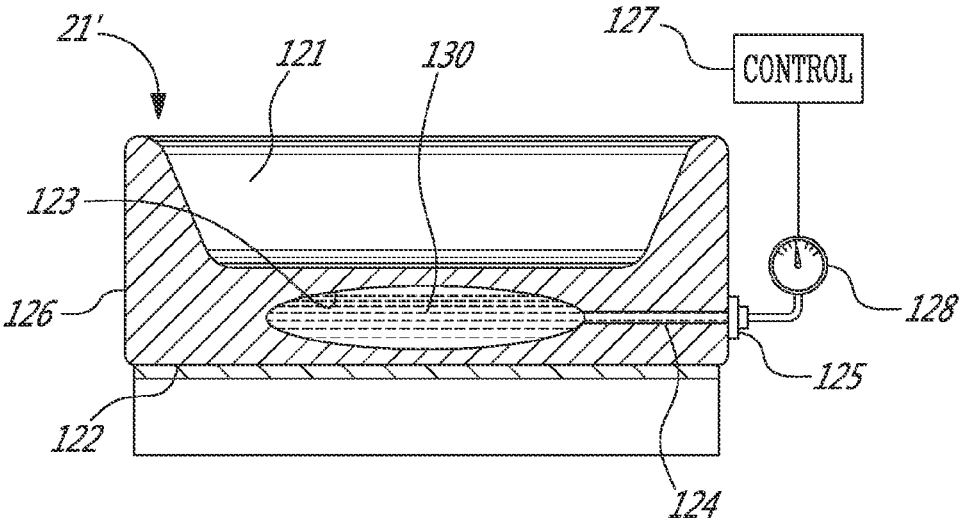
FIG. 16B is an enlarged view of the blow damping drive cap showing its construction to a pressure monitoring controller device.

With reference now to FIGS. 16A and 16B, there is shown the construction of the drive cap 21 herein designated by reference numeral 21'. The drive cap 21' is guidingly retained in a bottom end of the support housing 65 above the pile guiding assembly secured thereunder. The drive cap 21' has a top surface 120 provided with a cavity 121 shaped to receive the blunt steel working implement 18 with its flared end section 19. The drive cap 21' is a damping drive cap having an elastomeric material layer 122 secured therein to damper the impact blows of the working implement 18 whereby to dampen the blows and reduce noise. The drive cap 21' is also provided with a fluid chamber 123 to encapsulate therein a fluid. A fluid conduit 124 leads from the fluid chamber 123 to a coupling 125 secured to the side wall 126 of the drive cap 21'. A computer controller assembly 127 is secured to the connector 125 and provided with pressure sensing means in the form of a pressure gauge 128 to measure the pressure of the fluid 130 captive within the chamber 123 whereby to measure the impact force of the impact blows transmitted to the fluid and the pile in relation to the hardness of the soil in which the pile is driven. This computer controller or pressure monitoring means determines the hardness of the soil by measuring the resistance force of the pile as impact blows are generated on the drive cap 21' whereby to sense when the pile has reached a bedrock or a proper support strata within the ground.

It is within the ambit of the present invention to cover any obvious modifications of the preferred embodiment described herein, provided such modifications fall within the scope of the appended claims.

The invention claimed is:

1. A hydraulic breaker hammer casing assembly for converting a hydraulic breaker hammer to a pile driving apparatus, said casing assembly comprising a support housing configured to immovably secure therein a hydraulic breaker hammer; said support housing having protective side walls, one of said protective side walls connectable to a support member displaceable along a boom of a pile driving rig, an impact shaft of said hydraulic breaker hammer being positioned near a bottom end of said support housing; an attachment cylinder secured at said open bottom end of said support housing or adapted for securement to a bottom end of the hydraulic breaker hammer; a drive cap for vertical sliding fit in said attachment cylinder and transversely captive therein; and an adjustable pile guide housing secured adjacent a front open end of said attachment cylinder and secured to said support housing for seating engagement about a top end portion of a pile to orient said hydraulic breaker hammer support housing axially aligned with said pile and with said drive cap sitting on a top end of said pile, for guiding, in axial alignment with said impact shaft, said pile to be driven in a soil surface.

2. A hydraulic breaker hammer casing assembly as claimed in claim 1 further comprising a plurality of connecting rods secured at predetermined positions between said protective side walls for immovably securing the hydraulic breaker hammer, at least some of said connecting rods are provided in at least sections thereof with a sleeve of compressible material to protect said rods from direct frictional contact with said hydraulic breaker hammer and to dampen vibrations and sound.

3. A hydraulic breaker hammer casing assembly as claimed in claim 2 wherein there is further provided two or more transverse recess engaging plates disposed in transverse recess areas of said hydraulic breaker hammer extending between a front wall and a rear one of said protective side walls, some of said connecting rods extending in close sliding fit through holes provided in said transverse recess engaging plates.

4. A hydraulic breaker hammer casing assembly as claimed in claim 1 wherein the one of said protective side walls connectable to the support member is a rear one of said side walls.

5. A hydraulic breaker hammer casing assembly as claimed in claim 4 wherein the rear one of said side walls includes an adjustable attachment means for adjustably securing same to a carriage displaceable along said boom, and connection means for adjustable connection of said breaker hammer casing assembly on said boom.

6. A hydraulic breaker hammer casing assembly as claimed in claim 5 wherein said adjustable attachment means is constituted by a plurality of fastener bores disposed in alignment in said rear one of said protective side walls.

7. A hydraulic breaker hammer casing assembly as claimed in claim 4 further comprising slide engaging sleeves secured to an outer surface of said rear one of said protective side walls for displaceable sliding engagement with a support of said boom.

8. A hydraulic breaker hammer casing assembly as claimed in claim 1 wherein said pile guiding assembly is secured to an attachment means secured at said bottom end of said support housing and the attachment cylinder is adapted for securement to said attachment means.

9. A hydraulic breaker hammer casing assembly as claimed in claim 8 wherein said attachment means comprises a square bracket surrounding said bottom end, said attachment cylinder having a square cross-section, and a plurality of fastener receiving holes about a rear end portion of said attachment cylinder for receiving fasteners for connection to said square bracket.

10. A hydraulic breaker hammer casing assembly as claimed in claim 9 wherein said attachment means further comprises a projecting flange projecting from a lower edge of said rear support wall and adapted for connection with a connecting flange of said pile guide housing.

11. A hydraulic breaker hammer casing assembly as claimed in claim 1 wherein said adjustable pile guide housing is a rectangular open-ended housing having opposed top and bottom flat walls and a pair of parallel side walls, a large opening provided in said top and bottom flat walls and aligned with one another and dimensioned for the passage of a top end portion of a pile to be received therethrough, a pair of slide guide blocks retained captive in said open-ended housing by end walls secured to said open-ended housing and obstructing said open ends of said housing, said slide guide blocks adjustably securable at predetermined locations on a respective side of said pile guide housing, said slide guide blocks having a shaped formation in an inner wall thereof facing one another on opposed sides of said large opening.

12. A hydraulic breaker hammer casing assembly as claimed in claim 11 wherein said shaped formation is configured to guide in sliding relationship therebetween one of cylindrical or square cross-section piles and other cross-section shaped piles.

13. A hydraulic breaker hammer casing assembly as claimed in claim 11 wherein said adjustable pile guide housing includes two or more rows of aligned holes provided in said pair of parallel side walls, and said slide guide blocks include two or more through bores extending across said slide guide blocks and disposed for alignment with selected ones of holes in adjacent ones of said two or more rows, the assembly further comprising connecting rods disposed in selected ones of said holes and through bores for securing said slide guide blocks at said predetermined location.

14. A hydraulic breaker hammer casing assembly as claimed in claim 13 wherein said connecting rod is comprised by a pair of connecting rods interconnected in parallel relationship by a transverse arm at an end thereof, and a handle formation secured to said transverse arm for inserting and withdrawing said pair of connecting rods from said selected ones of a pair of said holes and through bores.

15. A hydraulic breaker hammer casing assembly as claimed in claim 11 wherein said end wall is provided with an opening therein for access to a rear flat wall of said slide guide block disposed adjacent thereto.

16. A hydraulic breaker hammer casing assembly as claimed in claim 1 further comprising a slide plate having two or more axially aligned first connecting members and two or more axially aligned second connecting members secured to a side wall of said protective side walls, said first and second connecting members being configured for inter-engagement with one another.

17. A hydraulic breaker hammer casing assembly as claimed in claim 16 wherein there is further provided a lock for locking said first and second connecting members in inter-engagement.

18. A hydraulic breaker hammer casing assembly as claimed in claim 17 wherein said first connecting members are seating blocks disposed spaced-apart on a flat surface of said slide plate, each seating block having a tongue formation extending outwardly at a top end thereof, said second connecting members being spaced-apart connecting cavities formed in at least a flat portion of one of said protective side walls and configured to receive an associated one of said seating blocks therein, said cavities each having a tongue engaging formation in a top edge thereof for seating engagement on said tongue formation of its associated seating block.

19. A hydraulic breaker hammer casing assembly as claimed in claim 18 wherein said tongue formation defines an angulated flat slide ramp section extending from a free outer edge thereof to said flat surface of said slide plate, and opposed sloped side edges extending angularly inwards form said flat surface to said free outer edge of said tongue, said tongue formations guiding said seating blocks for inter-engagement with said connecting cavities.

20. A hydraulic breaker hammer casing assembly as claimed in claim 19 wherein said tongue engaging formation of each said connecting cavities is constituted by an inward upwardly sloping seating wall for sliding engagement on said flat slide ramp of said tongue formation of its associated seating block, and opposed angularly and inwardly sloping guide edges extending from opposed edges of said connecting cavities to said seating wall.

21. A hydraulic breaker hammer casing assembly as claimed in claim 18 wherein said lock comprises a transverse slot formed in said flat surface of said slide plate and a flat lock bar configured for close sliding fit reception in said transverse slot with said flat lock bar extending in axial captive retention between aligned guide brackets formed on opposed sides of said side wall of said protective side walls whereby to interlock said slide plate on said side wall to prevent disengagement of said first connecting members with said second connecting members.

22. A hydraulic breaker hammer casing assembly as claimed in claim 16 wherein said slide plate is provided with slide arms for sliding displacement along said boom of a pile driving rig and connecting means to secure said slide plate to a plate displacing means.

23. A hydraulic breaker hammer casing assembly as claimed in claim 1 wherein said support housing has a top wall secured to a winch cable of a motor driven winch mounted at a top end of said boom of said pile driving rig, said motor driven winch positioning said pile guiding assembly at a top end of a pile to be driven into the ground by impact blows of said hydraulic breaker hammer and the total weight of said hydraulic breaker hammer casing assembly.

24. A hydraulic breaker hammer casing assembly as claimed in claim 1 wherein said support member is secured to an endless drive attachment tether capable of imparting an upward pulling force and a downward pulling force to said support member to position said pile guiding assembly at a top end of said pile to be driven into the ground and to provide a downward pulling force on said hydraulic breaker hammer casing assembly when said hydraulic breaker hammer generates impact blows to provide additional driving force at said top end of said pile.

25. A hydraulic breaker hammer casing assembly as claimed in claim 24 wherein said endless drive attachment tether is a chain drive secured to said boom of said pile driving rig.

26. A hydraulic breaker hammer casing assembly as claimed in claim 24 wherein said support member is secured to a lowermost portion of one of said protective side walls wherein said support member, when drawn to a top end of said boom, said support housing will partly project over said top end of said boom wherein said boom may be constructed of a shorter length to accommodate a pile or provide for the driving of longer pile length with the same boom length.

27. A hydraulic breaker hammer casing assembly as claimed in claim 1 wherein the drive cap is guidingly retained in a bottom end of said support housing, said drive cap having a top surface shaped to receive a free end of said impact shaft on an upper surface thereof and transferring impact blows therefrom to a top end of said pile to be driven in said ground.

28. A hydraulic breaker hammer casing assembly as claimed in claim 27 wherein said drive cap is a blow damping drive cap having an elastomeric material therein to dampen said impact blows.

29. A hydraulic breaker hammer casing assembly as claimed in claim 27 wherein said drive cap is provided with a fluid chamber, a fluid conduit leading to said fluid chamber, and fluid pressure monitoring means secured to said fluid conduit to measure the fluid pressure created by the impact force of said impact blows transmitted to said pile in relation to the hardness of said ground in which said pile is driven, said fluid pressure monitoring means determining said hardness of said ground by the measured resistance force of said pile.

30. A hydraulic breaker hammer casing assembly as claimed in claim 1 wherein said attachment cylinder is detachably connected to a support attachment secured at said bottom end of said support housing.

31. A hydraulic breaker hammer casing assembly as claimed in claim 30 further comprising a support frame having a top wall, a pair of parallel guide flanges secured on a top surface of said support frame for removable engagement with said support attachment, a pile passing between said pair of guide flanges and configured to receive said pile in close sliding fit therein, and pile guide means projecting from a lower surface of said support housing for guiding a top end of said pile into said pile passage.

32. A hydraulic breaker hammer casing assembly as claimed in claim 31 wherein said support attachment is constituted by a pair of slide flanges, each slide flange of said pair of slide flanges being secured to a respective side of said open bottom end of said support housing and disposed parallel to one another, said guide flanges being slidingly supported by said pair of slide flanges, and a connector for immovably connecting said guide flanges to said slide flanges.

33. A hydraulic breaker hammer casing assembly as claimed in claim 32 wherein said connector is a connecting pin extending in a connector bore of one of said guide flanges and into a bore in an associated slide flange.

34. A hydraulic breaker hammer casing assembly as claimed in claim 31 further comprising a plurality of depending guide finger members secured to said lower surface of said support frame and spaced-apart about said pile passage, said guide finger members having an inner angulated guide edge sloping outwardly from about said pile passage to an outer end thereof to create an enlarged guide opening to capture said top end of said pile and guide it into said pile passage.

35. A hydraulic breaker hammer casing assembly as claimed in claim 30 wherein said adjustable pile guide housing is a rectangular open-ended housing having opposed top and bottom flat walls and a pair of parallel side walls, a large opening provided in said top and bottom flat walls and aligned with one another and dimensioned for the passage of a top end portion of a pile to be received therethrough, a pair of slide guide blocks retained captive in said open-ended housing by end walls secured to said open-ended housing and obstructing said open ends of said housing, said slide guide blocks adjustably securable at predetermined locations on a respective side of said pile guide housing, said slide guide blocks having a shaped formation in an inner wall thereof facing one another on opposed sides of said large opening, and a pair of parallel guide flanges secured on a top surface of said open-ended housing for removable engagement with said support attachment.

36. A hydraulic breaker hammer casing assembly as claimed in claim 35 wherein said support attachment is constituted by a pair of slide flanges, each slide flange of said pair of slide flanges being secured to a respective side of said open bottom end of said support housing and disposed parallel to one another, said guide flanges being slidingly supported by said pair of slide flanges, and a connector for immovably connecting said guide flanges to said slide flanges.

37. A hydraulic breaker hammer casing assembly as claimed in claim 36 wherein said shaped formation is configured to guide in sliding relationship therebetween one of cylindrical or square cross-section piles and other cross-section shaped piles.

38. A hydraulic breaker hammer casing assembly as claimed in claim 36 wherein said adjustable guide pile housing includes two or more rows of aligned holes provided in said pair of parallel side walls, and said slide guide blocks include two or more through bores extending across said slide guide blocks and disposed for alignment with selected ones of holes in adjacent ones of said two or more rows, the assembly further comprising connecting rods disposed in selected ones of said holes and through bores for securing said slide guide blocks at said predetermined location.

39. A hydraulic breaker hammer casing assembly as claimed in claim 38 wherein said connecting rod is comprised by a pair of connecting rods interconnected in parallel relationship by a transverse arm at an end thereof, and a handle formation secured to said transverse arm for inserting and withdrawing said pair of connecting rods from said selected ones of a pair of said holes and through bores.

40. An adjustable pile guide housing for displaceable securement under a drive cap seated on a top end of a pile and impacted by a pile driver, said adjustable pile guide housing being a rectangular open-ended housing having opposed top and bottom flat walls and a pair of parallel side walls, a large opening provided in said top and bottom flat walls and aligned with one another and dimensioned for the passage of a top end portion of a pile to be received therethrough, a pair of slide guide blocks retained captive in said open-ended housing by end walls secured to said open-ended housing and obstructing said open ends of said housing, said slide guide blocks adjustably securable at predetermined locations on a respective side of said pile guide housing, said slide guide blocks having a shaped formation in an inner wall thereof facing one another on opposed sides of said large opening.

41. An adjustable pile guide housing as claimed in claim 40 wherein said shaped formation is configured to guide in sliding relationship therebetween one of cylindrical or square cross-section piles and other cross-section shaped piles.

42. An adjustable pile guide housing as claimed in claim 40 wherein said adjustable pile guide housing includes two or more rows of aligned holes provided in said pair of parallel side walls, and said slide guide blocks include two or more through bores extending across said slide guide blocks and disposed for alignment with selected ones of holes in adjacent ones of said two or more rows, and the assembly further comprising connecting rods disposed in selected ones of said holes and through bores for securing said slide guide blocks at said predetermined location.

43. An adjustable pile guide housing as claimed in claim 42 wherein said connecting rods is comprised by a pair of connecting rods interconnected in parallel relationship by a transverse arm at an end thereof, and a handle formation secured to said transverse arm for inserting and withdrawing said pair of connecting rods from said selected ones of a pair of said holes and through bores.

44. A blow damping drive cap in combination with a pile driving hammer for transmitting impact forces from said pile driving hammer, said drive cap having a fluid chamber and a fluid conduit leading to said fluid chamber and fluid pressure monitoring means secured to said fluid conduit to measure the impact force of said impact blows transmitted to said pile in relation to the hardness of the ground in which said pile is driven, said fluid pressure monitoring means determining said hardness of said ground by the measured resistance force of said pile.

45. A blow damping drive cap as claimed in claim 44 in combination with claim 1.

46. A hydraulic breaker hammer casing assembly for converting a hydraulic breaker hammer to a pile driving apparatus, said casing assembly comprising a support housing configured to immovably secure therein a hydraulic breaker hammer; said support housing having protective side walls, one of said protective side walls connectable to a support member displaceable along a boom of a pile driving rig, an impact shaft of said hydraulic breaker hammer being positioned near a bottom end of said support housing; a pile guide assembly secured at said open bottom end of said support housing for guiding, in axial alignment with said impact shaft, a pile to be driven in a soil surface, wherein one of said protective side walls of said support housing being spaced from said hydraulic breaker hammer to create a protective space, the protective space housing:

hydraulic and electrical lines and connections thereof; or a cable guided by a cable winch for connection to an attachment element at a bottom end of said support housing, wherein said cable is capable of being attached to a pile top end portion for lifting said pile and guiding said top end portion of said pile under said open bottom end of said support housing by displacing said support housing upwardly along said boom.

47. A hydraulic breaker hammer casing assembly as claimed in claim 46 wherein said protective space accommodates hydraulic and electrical lines therein secured to a connection block in a lower side section of said support housing, and a connector mechanism for connecting flexible supply conduits to said connection block, said flexible supply conduits housing hydraulic and electrical supply lines for connection to said hydraulic and electrical lines in said protective space.

48. A hydraulic breaker hammer casing assembly as claimed in claim 46 wherein said support housing has a top wall, said cable winch being mounted on said top wall and having a guide pulley to guide the cable from a driven spool of said winch downwardly into said protective space for connection to the attachment element at a bottom end of said support housing.

49. A hydraulic breaker hammer casing assembly as claimed in claim 48 wherein a guide bracket is secured adjacent said bottom open end of said support housing for guiding said cable therethrough, said attachment element being a hook element.

50. A hydraulic breaker hammer casing assembly as claimed in claim 46 wherein said support housing has a top wall, said protective space housing hydraulic and electrical lines and connections thereof, said hydraulic breaker hammer being protected from foreign elements by said support housing.

51. A hydraulic breaker hammer casing assembly as claimed in claim 50 wherein at least one of said protective side walls is a removable side wall for access to said hydraulic breaker hammer and said protective space.

* * * * *